United States Patent [19]

Smith et al.

[11] 4,240,766

[45] Dec. 23, 1980

[54] TRAFFIC DELINEATOR

[76] Inventors: William P. Smith, 9009 Covina, San Diego, Calif. 92126; Dave R. Halsey, 9959 El Nopal, Santee, Calif. 92071

[21] Appl. No.: 9,664

[22] Filed: Feb. 5, 1979

[51] Int. Cl.[3] ..... E01F 9/00

[52] U.S. Cl. ..... 404/10; 52/298; 256/1; 256/13.1; 40/607; 248/160

[58] Field of Search ..... 404/10, 9, 15, 16; 52/298, 297; 256/13.1, 1; 116/63 R; 40/607, 608, 612; 248/160

[56] References Cited

U.S. PATENT DOCUMENTS

| | | | |
|---|---|---|---|
| 302,910 | 8/1884 | Holmes | 52/297 |
| 337,163 | 3/1886 | Kezlogg | 52/297 |
| 2,018,260 | 10/1935 | Henderson | 404/15 |
| 2,121,961 | 6/1938 | Gill | 404/10 |
| 2,210,441 | 8/1940 | Bachman | 52/297 |
| 3,212,415 | 10/1965 | Byrd | 404/10 |
| 3,335,534 | 8/1967 | Hester | 256/13.1 |
| 3,371,647 | 3/1968 | Shopbell | 404/10 X |
| 3,612,287 | 10/1971 | Maltese | 52/297 |
| 3,902,818 | 9/1975 | Boone | 404/10 |
| 4,078,867 | 3/1978 | Ronden | 404/10 |

FOREIGN PATENT DOCUMENTS

| | | | |
|---|---|---|---|
| 129447 | of 1932 | Austria | 404/10 |
| 940775 | 11/1963 | United Kingdom | 404/10 |

*Primary Examiner*—Nile C. Byers, Jr.
*Attorney, Agent, or Firm*—Henri J. A. Charmasson

[57] ABSTRACT

A moveable device used for delineating traffic lanes, adapted to be selectively placed into permanent dug holes for channeling vehicular traffic. The device comprises a bendable tubular post of polyethylene fastened to a rigid conical base. The base has a downward circular anchoring extension which can be inserted into a dug hole. The base has a very low above-ground profile and can be impacted by high speed vehicles without being damaged or pulled off the ground.

7 Claims, 5 Drawing Figures

TRAFFIC DELINEATOR

BACKGROUND OF THE INVENTION

A requirement has long existed for traffic markers which can be quickly installed and removed in such a way as to visually delineate temporary path for vehicles. Along certain thoroughfares or at certain crossroads, during certain periods such as early morning and late afternoon rush hours, traffic must be temporarily channeled in a particular pattern to avoid bottlenecks. For instance, more lanes may be dedicated to the traffic going in one particular direction than the opposite traffic. Left turns cutting through cross traffic lanes may have to be temporarily blocked. These procedures are particularly necessary in the vicinity of sports arenas and other large congregating sites in order to regulate pre and post event traffic. Although these traffic patterns are created for short periods of time, often not exceeding a couple of hours, they tend to be repetitive and must be recreated every day or every time a stadium or other public site draws a large crowd.

There is thus created a need for a traffic delineating device which can rapidly be installed and removed on a periodic and repetitive basis. The device must be able to withstand very heavy vehicular traffic. Several types of modifiable traffic lane markers have been offered in the past. Typical of those are the devices disclosed in U.S. Pat. No. 3,212,415, Byrd, and U.S. Pat. No. 3,902,818, Boone. These designs require that permanent base unit be installed above ground where they are soon damaged by the repetitive impact of high speed vehicle wheels. These bases also creates traffic hazard, and can cause damage to tires and rims.

U.S. Pat. No. 3,279,133, De Korte, discloses a type of moveable marker which does not necessitate an above ground permanent structure. However, the depth of the dug hole makes it very difficult to clean as gravels and roadway litter may accumulate into it. Furthermore, the shape of the inserted part of the post supporting base makes it awkward to install.

SUMMARY OF THE INVENTION

A traffic delineator which comprises a bendable post removably fastened into a heavy metal base. The base has a low conical profile and a downward cylindrical extension which drops into a sleeved ground socket. The cylindrical extension has a rounded or tapered tip to facilitate insertion into the ground socket.

It is the principal object of this invention to provide temporary traffic lane delineators which can be quickly installed by dropping them from the back of a moving truck.

It is also an object of this invention to provide traffic lane delineators which can be quickly gathered when no longer needed by a person riding on the back of a moving truck.

A further object of this invention is to provide a traffic delineator which is immune to repeated impact by moving vehicles.

Still another object of this invention is to provide a traffic lane delineator which when struck by a vehicle will not result in any damage or danger to the vehicle nor discomfort to its occupants.

Yet another purpose of the invention is to provide a ground insertable traffic delineator which although it can be easily installed or pulled out by vertical motion, will not be upset when subject to horizontally directed impacts.

It is also the purpose of this invention to provide a permanent ground imbedded socket for a traffic delineator which is easy to keep clean from gravel and other roadway debris.

IN THE DRAWINGS

DESCRIPTION OF THE PREFERRED EMBODIMENTS

Figure 1:
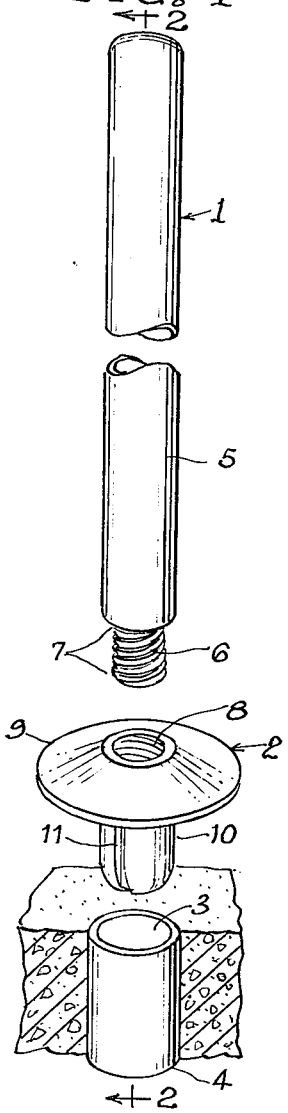
FIG. 1 is a perspective view of the traffic delineator according to the invention showing its three principal elements, the post, a first embodiment of the base, and the ground socket separately.

According to the invention and with reference to the drawing, a traffic delineator which comprises an elongated homogenous, tubular post 1 having a hollow main body 5 terminating in a cylindrical threaded narrow end 6 and threads 7.

The post is made of polymeric material suitably blended to provide a resilient post which can be bended on impact and is useable in all weather conditions such as is specified in U.S. Pat. No. 4,078,867, Ronden.

A metallic base 2 is provided having a generally conical main body 9 of low profile. A cylindrical well 8 extending vertically from the apex of the base 2 has threadings matching the threads 7 of the end 6 of the post 1. A stud 10 extends concentrically downward from the bottom of the base 2. The stud 10 is cylindrical and has rounded or tapered angles at the bottom 12. A vertical groove 11 runs along the side of the stud 10. Embedded in the pavement surface is a cylindrical sleeve 4, forming a dug hole 3 dimensioned to receive the cylindrical stud 10.

The height of the post can be adequately set at 125 centimeters (50 inches). The outside diameter of the base is approximately 50 centimeters (6 inches). The above-ground height of the base should not exceed four centimeters (1½ inches). The stud length should have a minimum of ten centimeters (4 inches) and a diameter of at least five centimeters (2 inches). The sleeved dug hole or socket 3 extends at least five centimeters (2 inches) beyond the length of the stud in order to provide room for accumulating gravels and debris. However, the length of the socket should not be such that it cannot be easily flushed from gravels and debris by means of a compressed air gun or by means of a vacuum cleaner. The stud 10 should closely fit into the ground socket 3 but not so tightly that it cannot be easily removed by upward pulling action. During insertion of the stud 10, the groove 11 provides an exitway for air and for any water that may have accumulated into the socket 3.

Figure 2:
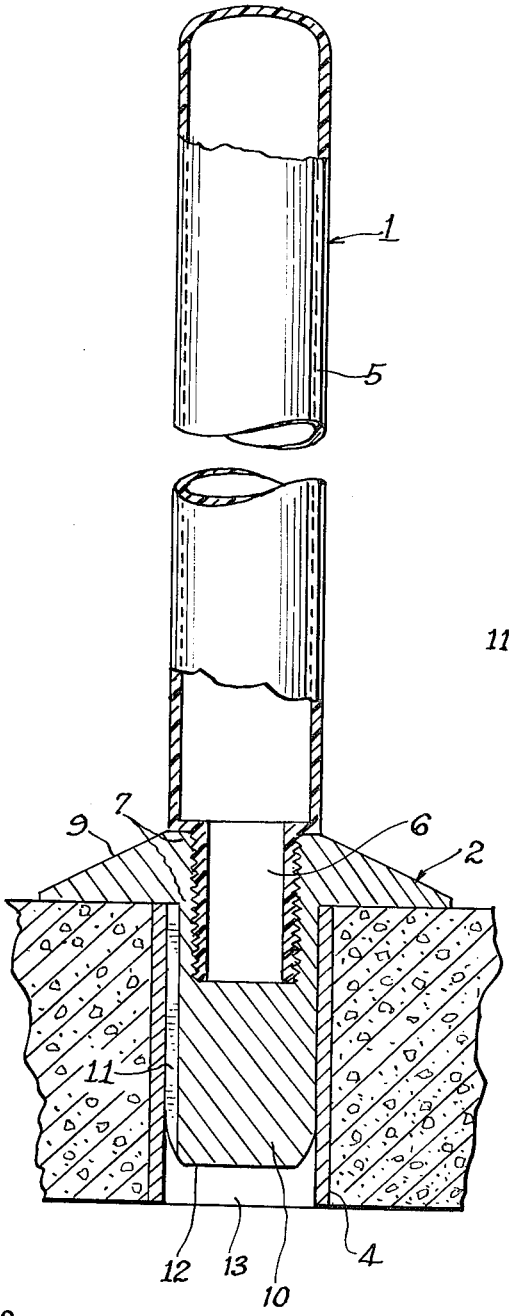
FIG. 2 is a cross-sectional view of the delineator taken along line 2—2 of FIG. 1.
Figure 3:
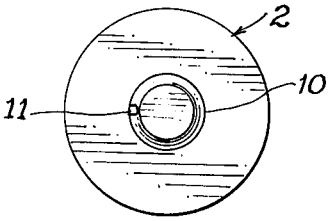
FIG. 3 is a bottom view of the first embodiment of the base.
Figure 4:
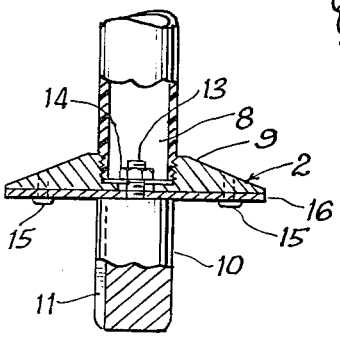
FIG. 4 is a partially cut-away view of a second embodiment of the base.
Figure 5:
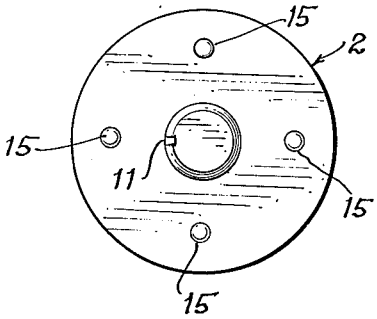
FIG. 5 is a bottom view thereof.

As more specifically illustrated in FIGS. 1 through 3, the first preferred embodiment of the invention comprises a base 2 made out of a solid piece of metal. A second preferred embodiment is illustrated in FIGS. 4 and 5. The base comprises a disk-shaped metallic sole 16 permanently fastened to a high-impact plastic body 9 by four rivets 15. The stud 10 is fastened to the base by means of a threaded stem 13 passing through holes into the middle of the base body 9 and sole 16, and engaging in nut 14 at the bottom of the well 8.

The post 1 is usually kept screwed into the base well 8, and is replaced only when damaged. For installation, a set of delineators is loaded on the bed of a truck. The delineators are dropped into place from the back of the moving vehicle. Once installed into the ground socket, they cannot be extracted by lateral blows from vehicles against the body 5 of the post 1 or by the impact of tires against the conical base 2. The low angle slant of the base 2 combines with its broad overlapping of the brim of ground socket 3 and with the position and close fitting of the stud 10 into the socket 3, to provide a solid anchor against lateral impacts from car tires. Yet, the device can be easily removed by vertical pulling action.

While only the preferred embodiments have been disclosed in great detail herein, it will be apparent to those skilled in the art that modifications thereof can be made without departing from the spirit of this invention.

I claim:

1. A readily removable device for delineating traffic lanes or the like which comprises:

an elongated tubular post made of lightweight pliable material having a cylindrical, threaded lower end;

a substantially conical base having at its apex a shallow well threaded and dimensioned to hold the lower end of the said post secured therein;

extending downward from the bottom center of said base and integrally therewith, a solid anchoring stud having a rounded lower end; and in the ground surface, at least one sleeved dug hole shaped and dimensioned to fit closely around said stud;

said anchoring stud being free from vertical restraint in relation to said dug hole other than the combined weight of said post base and stud.

2. The device claimed in claim 1 wherein said tubular post is made of a resilient polymeric material and said base and projection are made of solid hard material.

3. The device claimed in claim 2 wherein the base stud has a vertical groove running along one side.

4. The device claimed in claim 2 wherein said projection is rounded or tapered at the bottom tip.

5. The device claimed in claim 2 wherein:

said base comprises a substantially conical main body of hard plastic;

a disc-shaped metallic sole plate fastened to the bottom of said main body;

a cylindrical stud fastened to the bottom center of said sole plate;

means for fastening the sole plate to the main body; and means for fastening the stud to the sole plate.

6. The device claimed in claim 4 or claim 5 wherein said dug hole comprises a cylindrical sleeve having an inside cross diameter approximately equal to the outside cross diameter of said stud, and a length exceeding the length of said projection.

7. The device claimed in claim 1 wherein said elongated tubular post is made of resilient polymeric material, has an empty core and a threaded lower end;

said base has a low profile extending beyond the rim of said dug hole, and at its apex a well threaded and dimensioned to hold said threaded lower end;

said stud has rounded or tapered angles at the bottom and a vertical groove running along one side; and said dug hole comprises a metallic cylindrical sleeve having an inside cross diameter approximately equal to the outside cross diameter of said stud, and a length exceeding the length of said stud.

* * * * *